United States Patent [19]

Hänsch

[11] Patent Number: 5,052,667

[45] Date of Patent: Oct. 1, 1991

[54] DEVICE FOR THE COLLECTION OF FOLDED PRINTED SHEETS

[75] Inventor: Egon Hänsch, Wetzikon, Switzerland

[73] Assignee: Ferag AG, Hinwil, Switzerland

[21] Appl. No.: 349,303

[22] Filed: May 9, 1989

[30] Foreign Application Priority Data

May 11, 1988 [CH] Switzerland ..... 01795/88

[51] Int. Cl.[5] ..... B65H 5/30

[52] U.S. Cl. ..... 270/55; 270/54; 270/58; 270/57

[58] Field of Search ..... 270/54, 55, 57, 58

[56] References Cited

U.S. PATENT DOCUMENTS 3,951,399 4/1976 Reist .
4,058,202 11/1977 Reist et al. .
4,398,710 8/1983 Hansch ..... 270/55
4,408,754 10/1983 Meier .
4,408,755 10/1983 Meier ..... 270/57
4,489,930 12/1985 Meier .
4,684,116 8/1987 Hansch .
4,684,117 8/1987 Honegger et al. .
4,706,951 11/1987 Leu .
4,709,910 12/1987 Honegger .
4,735,406 4/1988 Weber .

FOREIGN PATENT DOCUMENTS 3616566 12/1986 Fed. Rep. of Germany .
641113 2/1984 Switzerland .

*Primary Examiner*—Edward K. Look
*Assistant Examiner*—Therese M. Newholm
*Attorney, Agent, or Firm*—Willian Brinks Olds Hofer Gilson & Lione

[57] ABSTRACT

Each support (14) of a collection drum for printed sheets (24) has attached to it carriages (36) which in the course of a revolution in the direction of rotation (U) carry out a conveyance stroke in and a return stroke opposite to arrow direction (F). Each carriage (36) is provided with swivelable clamping tongues (38) which are controllable by means of rail sections (86) which run parallel to the direction of movement (F) of the carriages (36) and can be moved in the direction (H). This means that the clamping tongues (38) can be closed or opened independently of the position and speed of the carriages (36). Each clamping tongue (38) clamps printed sheet halves (76, 76') of printed sheets (24) placed on the support (14) and on the support (14) following it, viewed in the direction of rotation (U) of this support (14).

19 Claims, 8 Drawing Sheets

DEVICE FOR THE COLLECTION OF FOLDED PRINTED SHEETS

BACKGROUND OF THE INVENTION

The present invention relates to a device for the collection of folded printed sheets.

Such a device is known from, for example, DE-OS 36 16 566 and corresponding U.S. Pat. 4,735,406. This device has three saddle-type supports disposed parallel to a common axis of rotation and rotating about said axis. Disposed in series in the direction of the axis of rotation are two feeders for placing printed sheets on the supports and a stapler for stapling together the printed sheets lying on top of one another. The printed sheets thus collated and stapled slide onto a conveyor belt to be conveyed away. For each support provision is made for an endless rotary chain with carriers, which act upon the printed sheets placed on the supports and convey them in the course of a revolution of the supports about the common axis of rotation from one feeder to the next, or to the stapler. Provision is made on either side of each support for guide plates which prevent the printed sheets from spreading out. In order to prevent the printed sheets from falling off the supports while they are being passed through under the axis of rotation, provision is made for a half cylindrical surface on which the printed sheets slide with their fold during the lower half of the rotary movement. Here the printed sheets can be damaged, in particular in the region of their fold. Since a gap must be present between the half cylindrical surface and the carriers, it is also possible for the printed sheets to pass out of reach of the carriers, so that they are no longer conveyed along and are damaged. Furthermore, the placing of the printed sheets on the supports gives rise to problems, since with continuously rotating supports the printed sheets have to be inserted into the gap between the supports and the guide plates.

Another device for the collection of folded printed sheets is known from EP-OS 00 95 603 or the corresponding U.S. Pat. No. 4,489,930. It has supports disposed like the rungs of a ladder on two parallel-rotating conveyor chains. At the beginning and end of the conveying stretch the conveyor chains are conveyed around deflection rollers. Printed sheets are placed astride the supports of the upper track by means of feed conveyors, and the printed sheets thus collected are lifted from the supports at the end of the conveying stretch and conveyed away.

It is a primary object of the present invention to produce a device for collecting folded printed sheets which is simple in design and permits reliable holding of the printed sheets on the supports, and thus avoids damage to the printed sheets.

SUMMARY OF THE INVENTION

According to this invention, a device for the collection of folded printed sheets comprises a plurality of saddle-type supports mounted for rotation along a closed trajectory and disposed parallel to each other and substantially at right angles to the direction of rotation. These supports are adapted to receive two printed sheets astride the supports placed on top of each other by means of at least two spaced apart feed stations for transport to a discharge station for removal of the collected printed sheets. A plurality of clamping arrangements are associated with the supports and operative to hold the deposited printed sheets along at least part of the trajectory.

The printed sheets are held by clamping arrangements which rotate with the supports, so that damage to the printed sheets due to relative movement between the printed sheets and the device for holding them is avoided. The clamping arrangements guarantee a specific position of the printed sheets, so that they always rest on the supports.

In a preferred embodiment the clamping arrangements can be shifted in the lengthwise direction of the supports. The printed sheets held by the clamping arrangements are moved along with them and therefore cannot separate from them during conveyance along the supports. The clamping arrangements thus also serve as means for advancing the printed sheets.

In the embodiment described below the clamps of the clamping arrangements can be opened and closed independently of their position and movement. This provides a device which can be adapted in a simple manner to the most varied requirements. In this embodiment, each clamp acts on two printed sheets, and high processing speeds are possible, since the carriages have to carry out only a limited stroke.

In a particularly simple embodiment the carriages disposed on either side of every other support are connected to each other, in order to carry out the conveyance and return stroke in synchronism. This embodiment includes a particularly simple control device for opening and closing the clamps.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 1:
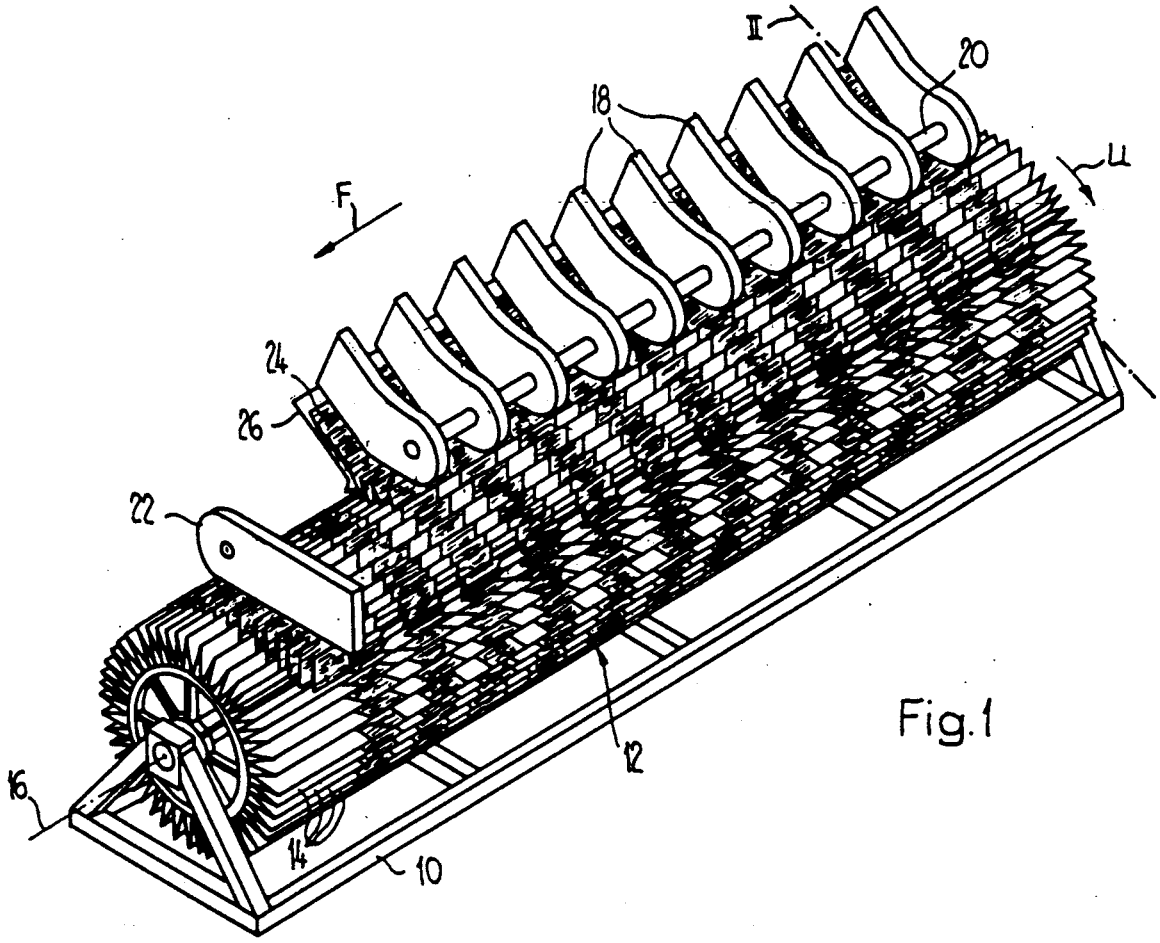
FIG. 1 shows a perspective view of an example of an embodiment of a collection drum.

FIG. 1 shows a rotary collection drum 12 which is rotatably mounted on a frame 10 and has a multiplicity of supports 14 which extend in the lengthwise direction of the collection drum 12 and rotate in common about the axis of rotation 16 in the direction of the arrow U. Provision is made above the collection drum 12 for ten schematically shown feed conveyors 18 which are spaced apart in the direction of the axis of rotation 16, and which are driven in synchronism by means of a common drive shaft 20. A discharge conveyor 22, also shown only schematically, is disposed in an end region of the collection drum 12 (at the end in the direction of the arrow F). The layout of such feed and discharge conveyors 18, 22 and the way in which they work are generally known and are described, for example, in DE-OS 36 20 945 or the corresponding U.S. Pat. No. 4,684.116. The feed conveyors 18 convey folded printed sheets 24 to the collection drum 12, where they are opened by means of an opening device 26, also shown only schematically, and are placed by the feed conveyors 18 on the supports 14 of the collection drum 12 or on the printed sheets 24 already on said supports. The first feed conveyor 18, viewed in the direction of the arrow F. places a printed sheet 24 astride each support 14 passing below it in the course of the revolutions of the collection drum 12 in the direction of rotation U. In the course of a revolution of the collection drum 12 these printed sheets 24 are conveyed in the arrow direction F along a spiral path to the next feed conveyor 18, which places a further printed sheet on each printed sheet 24, and these are then conveyed together to the next feed conveyor 18 in the course of the next revolution of the collection drum 12. This is repeated until, as shown in FIG. 1, ten folded printed sheets 24 are lying on top of each other. In the course of two further revolutions the printed sheets 24 thus collected are conveyed to the discharge conveyor 22, where they are seized and conveyed away. The printed sheets 24 lying on top of each other can be stapled or subjected to further processing operations in the region between the feed conveyors 18 and the discharge conveyor 22.

Figure 2:
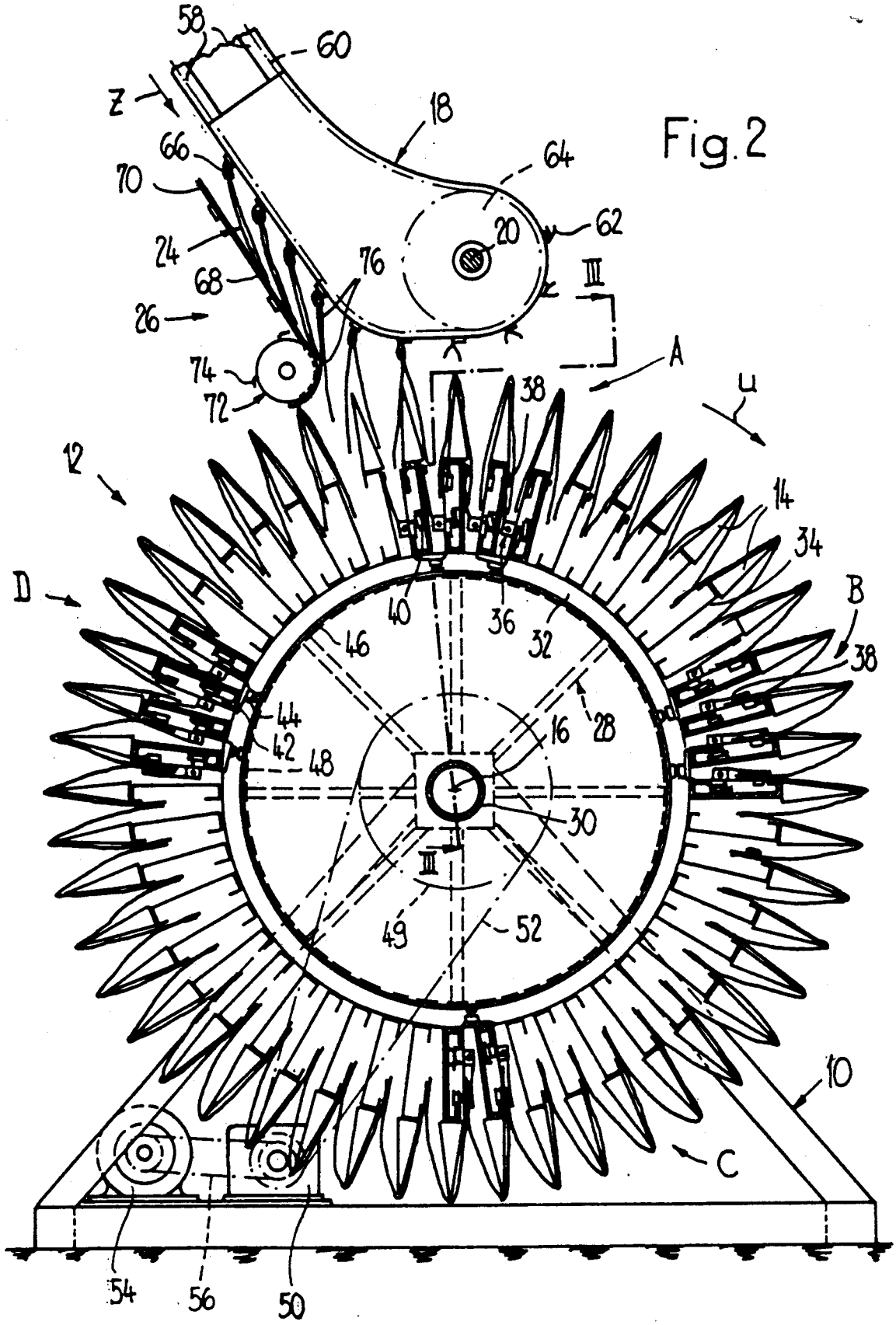
FIG. 2 shows an enlarged view of a vertical section along line II of FIG. 1.

FIG. 2 shows the collection drum 12 in a vertical section. The collection drum 12 has spoked wheels 28, only one of which is indicated by dashed lines in this figure. These spoked wheels 28 are rotatably mounted on a hollow shaft 30, which is held by the frame 10, and whose longitudinal axis coincides with the axis of rotation 16 (FIG. 1). C-shaped rails 34 are disposed on the rims 32 of the spoked wheels 28, running in the axial direction and spaced apart, viewed in the peripheral direction. A support 14 which is saddle-shaped in cross section is fixed on the outside of each rail 34, viewed in the radial direction. Carriages 36 are guided in each rail 34, only a few of these carriages 36 being shown in FIG. 2. These carriages 36 are described in greater detail below. For the moment it is sufficient to know that each of these carriages has clamping tongues 38, which can be taken by means of a control device 40 from an open position to a closed position, and vice versa.

Every two carriages 36 running in adjacent rails 34 are connected in pairs by means of a stirrup 42. Each stirrup 42 has disposed on it, viewed in the radial direction, an inward-projecting carrier 44 which is guided in a control link 46 which is provided on the cylindrical surface of a control cylinder 48 spaced inwards from the rails 34, viewed in the radial direction. The control cylinder 48 is non-rotationally mounted on the normally stationary hollow shaft 30.

On the outermost provided spoked wheel 28, viewed in the direction opposite to the arrow F (see FIG. 1). a chain wheel 49 is fixed which is operatively connected by means of a chain drive 52 (shown by dashed and dotted lines) to a gear 50 fixed on the frame 10. The gear 50 is driven by a drive motor 54, also fixed on the frame 10, by means of a further chain drive 56' also indicated by dashed and dotted lines.

The feed conveyor 18 has an endless traction element 60 (shown by dashed and dotted lines), which is guided in guides 58, and on which grippers 62, which are controllable individually, are provided at fixed distances in series. The traction element 60 is guided round a drive pulley 64 which is fixed on the drive shaft 20, and by means of which the traction element 60 can be driven in the direction of the arrow Z. Each gripper 62 conveyed to the collection drum 12 holds a printed sheet 24 by its fold 66. The ends 68 of the printed sheets 24 opposite the fold 66 and hanging down freely run onto a guide plate 70 of the opening device 26, so that the ends 68 run ahead of the fold 66. Viewed in the feed direction Z, provision is made at the end of the guide plate 70 for a rotary opening roller 72 with controllable clamps 74. The end 68 of the printed sheet half 76 which is running on the guide plate 70 is seized by a clamp 74 and folded over resting against the cylindrical surface of the opening roller 72, so that the two printed sheet halves 76 separate at least in the region of the ends 68, and the printed sheet 24 is thus opened. As soon as in the course of rotation of the collection drum 12 in the direction of rotation U a support 14 has travelled into an opened printed sheet 24, the relevant clamp 74 releases the end 68 of the printed sheet half 76 held by it, so that each printed sheet half 76 comes to rest on each side of the support 14. Once the gripper 62 in question has reached an approximately vertical position above the axis of rotation 16 of the collection drum 12, it is opened, and the released printed sheet 24 falls onto the support 14 and comes to rest on it. Similar opening devices 26 are described in greater detail in EP-OS 0 095.603 and EP-OS 0,208,081 or the corresponding U.S. Pat. Nos. 4,489,930 and 4,684,117.

The clamping tongues 38 located in the upper region of each collection drum 12 are in the open position, as indicated in the region shown by A. In the region indicated by B the clamping tongues 38 are conveyed into their clamping position by means of the control device 40, and this position is retained while the lower half C of the trajectory is being passed through. In the region D the clamping tongues 38 are then returned to their open position.

Figure 3:
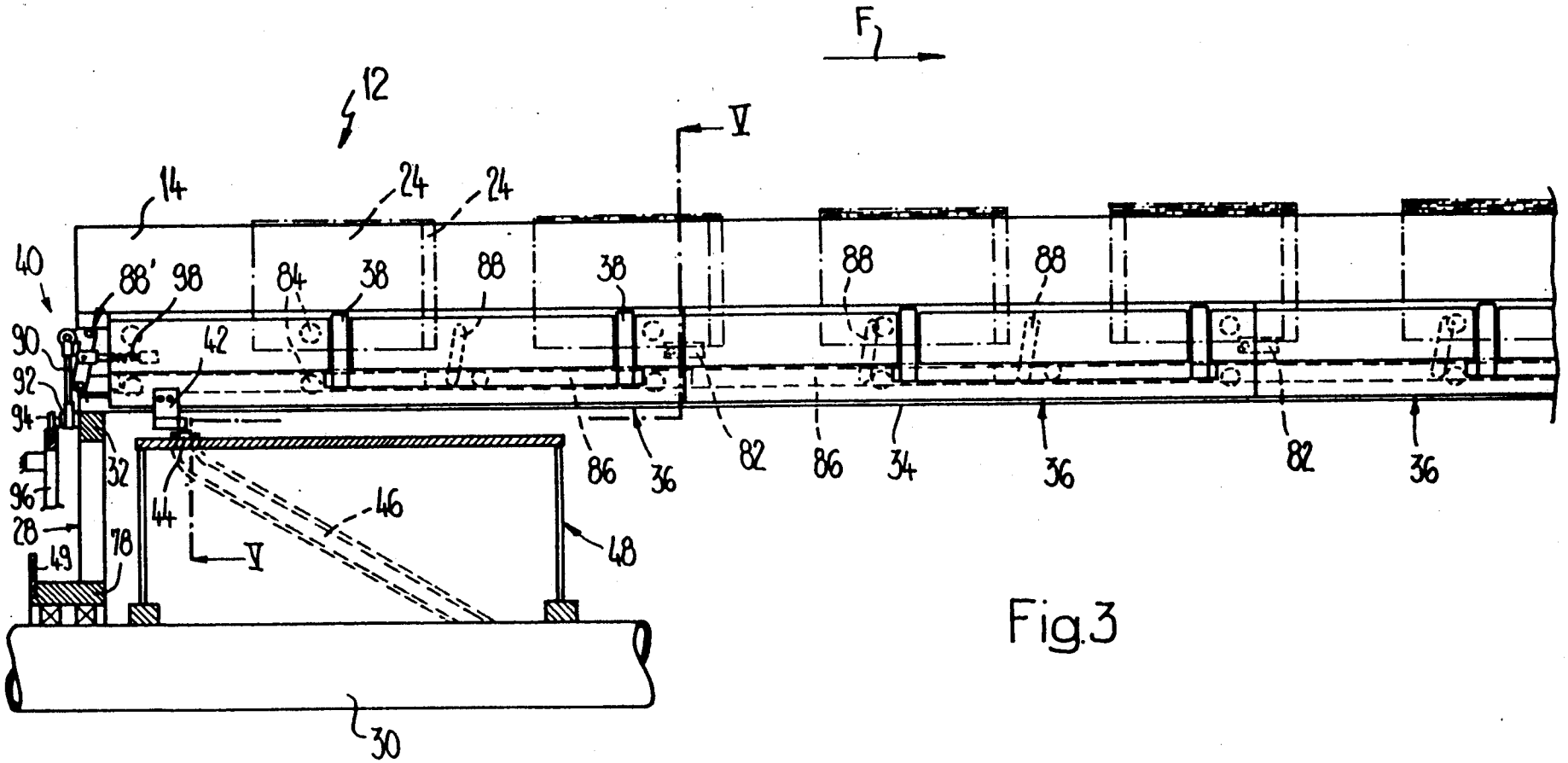
FIG. 3 shows a longitudinal section along line III—III of FIG. 2.

FIG. 3 shows a part of the collection drum 12 in a section along line III—III of FIG. 2. The one spoked wheel 28 visible in FIG. 3 is rotatably mounted on the hollow shaft 30, and the chain wheel 49 of the chain drive 52 is non-rotationally fixed on its hub 78 (see FIG. 2). The rail 34, which is C-shaped in cross section, and on which the support 14 rests, is fixed on the rim 32. Three carriages 36 which can be seen in this figure, and are connected to each other by means of coupling elements 82, are guided in the rail 34. Each carriage 36 has three or two guide roller pairs 84 which are rotatably mounted on it and run in the rail 34. Pivoted on each carriage 36 are two clamping tongues 38 which can be taken from their open position into the closed position and back by means of coupled rail sections 86 of the control device 40 (see FIG. 2).

Each rail section 86 is mounted like a parallel crank gear on two rocking levers 88, which for their part are swivelably mounted on the rail 34 and run parallel to each other. The rocking lever shown in FIG. 3 on the left end of the collection drum 12 and indicated by 88' is designed as an angle lever and is operatively connected by means of a piston rod 90 to the one arm of a twin-armed control lever 92 swivelably mounted on the rim 32, while a follower roller is rotatably mounted on the other arm and for its part rolls on a guide face of a fixed link 96. A compression spring 98 fixed at one end on the rail 34 and acting at the other end on the rocking lever 88', presses the follower roller 94 against the guide face of the link 96 and at the same time pretensions the clamping tongues 38 towards the open position.

Of all the carriages 36 guided in a rail 34 only the one in the region of the control cylinder 48 has a stirrup 42 by means of which it is connected to one of the adjacent carriages 36, viewed in the direction of rotation U (cf. FIG. 2). The carrier 44 disposed on the stirrup 42 runs in the enclosed control link 46 which is disposed on the cylindrical surface of the control cylinder 48, and which—viewed in the direction of the axis of rotation 16—has a sharp curve in each of the end regions and between these end regions a region with constant gradient as regards the direction of rotation U (in FIG. 3 only part of the control link 46 is shown).

On the support 14 folded printed sheets 24 fed in by the feed conveyors 18 (see FIG. 1) and held fast by the clamping tongues 38 are indicated by dashed and dotted lines and, viewed in the direction of conveyance F, starting from the left, in the case of the first clamping tongue 38 a single printed sheet 24 is lying on the support 14, in the case of the second clamping tongue 38 two printed sheets 24 are lying congruently on top of each other, in the case of the third clamping tongue 38 it is three of them, and so on. The printed sheets 24 shown in FIG. 3 displaced to the left in each case are lying on the rear support 14, viewed in the direction of rotation U (cf. FIG. 2).

Figure 4:
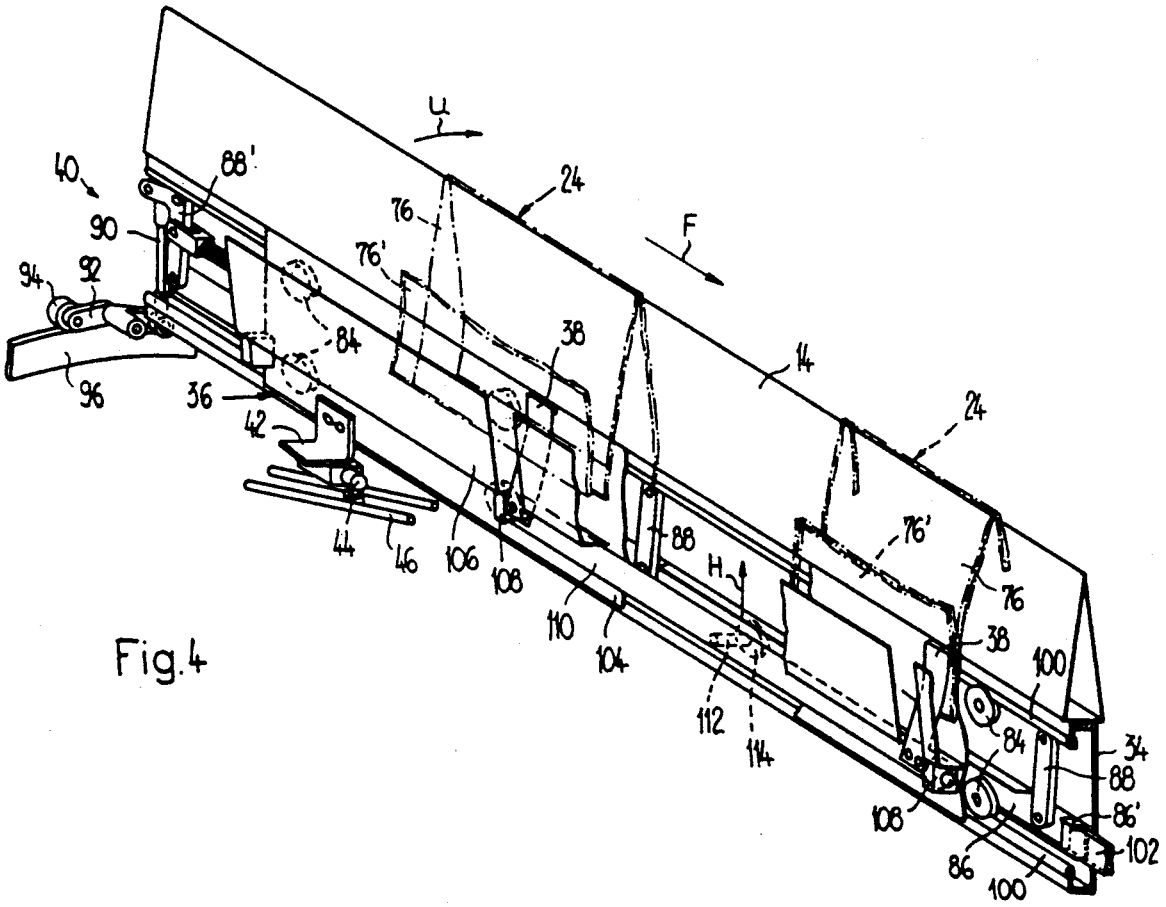
FIG. 4 shows a part of FIG. 3 in perspective, and simplified.

FIG. 4 shows part of the left half of FIG. 3 in perspective and on an enlarged scale, the carriage 36 being shown partially cut away. The same parts are indicated by the same reference numbers as in FIG. 3. These are discussed only insofar as is necessary for understanding FIG. 4. The ends of the C-shaped rail 34 facing each other each have a guide profile 100, for example made of plastic. The rollers of the guide roller pairs 84 rotatably mounted on the carriage 36 are made concave, so that they partially grip round the guide profile 100 and give the carriage 36 a certain hold in a direction at right angles to the rail 34. The rail 34 has pivoted on it the rocking levers 88, 88', whose free ends are connected to the rail section 86 in such a way that they swivel. The rail section 86 is also C-shaped in cross section, in the region of the rocking levers 88 the upper flank 86' always being recessed. Reference number 102 indicates a connecting piece connecting the rail section 86 to the next rail section 86, viewed in the direction F (see FIG. 3). When the rocking levers 88, 88' are swung from the position shown in FIGS. 3 and 4 in the clockwise direction the rail section 86 makes a movement like the couple of a parallel crank gear and thus also a movement in the direction of the arrow H (in the radial direction outwards). This movement of the rail section 86 is controlled by the follower roller 94 sliding on the link 96, the movement of said roller being transmitted by means of the control lever 92 and the piston rod 90 to the rocking lever 88' designed as an angle lever.

The carriage 36 has a flat wall element 104 on which the guide roller pairs 84 are mounted. On the wall element 104, at the side facing away from the rail 34, there is an upward bent guide element 106 which forms a pocket with a bottom, and which is cut out in the region of the clamping tongues 38. The clamping tongues 38, which are preferably made of spring steel, are fixed to a shaft 110 which is swivelably mounted by means of bearing elements 108 on the wall element 104 and runs in the lengthwise direction of the rail 34, and which runs below the bottom of the guide element 106. The upward-projecting free ends of the clamping tongues 38 can bear clamping supports, for example made of rubber. A lever arm 112 projecting towards the rail section 86 is fixed on the shaft 110 approximately halfway between the two clamping tongues 38, on the free end of which arm a roller 114 guided in the C-shaped rail section 86 is rotatably mounted. When the carriage 36 is moved in the direction of the arrow F or in the opposite direction the roller 114 slides in the rail section 86, and when the rail section 86 is raised or lowered in the direction of the arrow H or in the opposite direction the two clamping tongues 34 are swung into the open or closed position.

During rotation of the rail 34 and support 14 in the direction of the arrow U the carriage 36 makes a conveyance stroke in the direction of the arrow F and in the opposite direction a return stroke according to the control link 46 in which the carrier 44 is sliding. In this FIG. 4 also, as in FIG. 3, the individual printed sheets 24, or those deposited on top of each other on the support 14 are shown by dotted and dashed lines. It should be noted that each clamping tongue 38 holds rear printed sheet halves 76 of the printed sheets 24 which are placed on the support 14 and leading printed sheet halves 76' of the printed sheets 24 which are placed on the support 14 following this support 14 (not shown), viewed in the direction of rotation U, and these printed sheets 24 are staggered relative to each other, always viewed in the direction of the arrow F. This also applies to the printed sheets 24 shown on the right of FIG. 4, but they are shown cut away on their righthand side. For the sake of completeness, it should be pointed out that each support 14 of the collection drum 12 together with the rail 34, carriage 36 and control device 40 attached to it is of the same layout as the support (14) shown in FIGS. 3 and 4.

Figure 5:
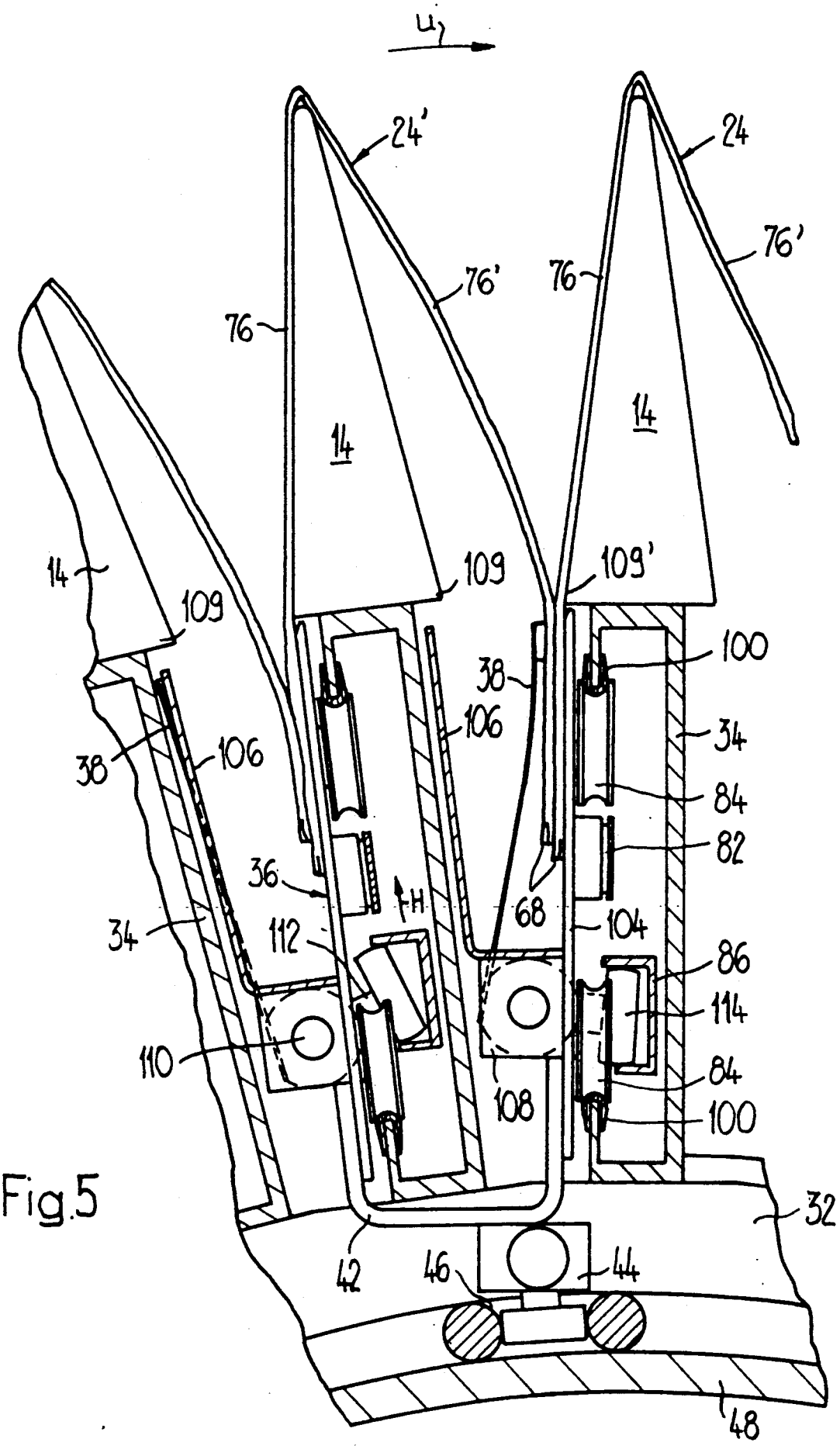
FIGS. 5 and 6 show on an enlarged scale a section along line V—V of FIG. 3 in the region of the points shown by B and D in FIG. 2, with one and two printed sheets, respectively, placed on the supports.

FIG. 5 shows a section along the line V—V of FIG. 3 through several supports 14 of the collection drum 12, the supports 14 being in the region B of FIG. 2. The rails 34 are fixed on the rim 32 of the spoked wheel 28 (see FIGS. 2 and 3). and the saddle-type supports 14 rest on them directed radially outwards. Disposed on the facing ends of the rails 34 are the guide profiles 100, on which the guide roller pairs 84 of the carriages 36 are guided. The guide roller pairs 84 are rotatably mounted on the wall element 104, and the guide element 106 and the bearing elements 108, only one of which can be seen in FIG. 5 for each carriage 36, are fixed on said wall element. It should be noted that the upper end of the guide element 106, viewed in the direction of rotation U. extends behind the leading edge 109' of the following support 14. The upper end of the wall element 104 is also covered by the following edge 109 of the corresponding support 14, so that the ends 68 of the printed sheets 24, when placed on the supports 14, can come to rest without any problem in the region of the clamping tongues 38. The clamping tongues 38 are fixed on the shaft 110 which is mounted on the bearing elements 108, and from which shaft the lever arm 112 projects towards the rail section 86. Rotatably mounted on the free end of the lever arm 112 is the roller 114 which is guided in the rail section 86, and has a convex bearing surface. The suspension and actuation device for the rail section 86 are not shown in this FIG. 5. The rail section 86 shown on the left in FIG. 5 is in arrow direction H in the upper outer end position, in the radial direction, so that the clamping tongues 38 concerned are in their open position, in which the free ends of the clamping tongues 38, viewed in the direction of rotation U, come to rest behind the guide element 106, and the clamping tongues 38 are covered by the guide element 106. The rail section 86 shown in this figure on the right is in the lower, radially inner end position opposite to the direction of the arrow H. so that the appropriate clamping tongues 38 are taken to the closed position, in which they clamp the printed sheet halves 76, 76' between them and the end stop formed by the wall element 104. It should be noted that a single printed sheet 24 is astride each support 14 and each clamping tongue 38 clamps the printed sheet halves 76, 76' of the two different printed sheets 24, namely the rear printed sheet half 76 of the printed sheet 24 leading at the time and the leading printed sheet half 76' of the printed sheet 24 following it at the time.

Since the supports 14 shown in FIG. 5 are in the region B of FIG. 2, the leading printed sheet halves 76', as a result of their own weight, already lie on the following printed sheet half 76 of the particular printed sheet 24 ahead of it, so that no pull is exerted on the printed sheets 24 during closing of the clamping tongues 38.

It should be noted that the two carriages 36 shown in this FIG. 5 are operatively connected to each other by means of the stirrup 42 but that the rail sections 86 can be controlled independently of each other. It can be seen particularly clearly from this figure that the carrier 44 has a roller which is guided on two round profiles which are disposed parallel to each other on the control cylinder 48, and have a circular cross section, and whose facing surfaces form the control link 46. Reference number 82 indicates the coupling elements by means of which the carriages 36 guided in a rail 34 are coupled together.

Figure 6:
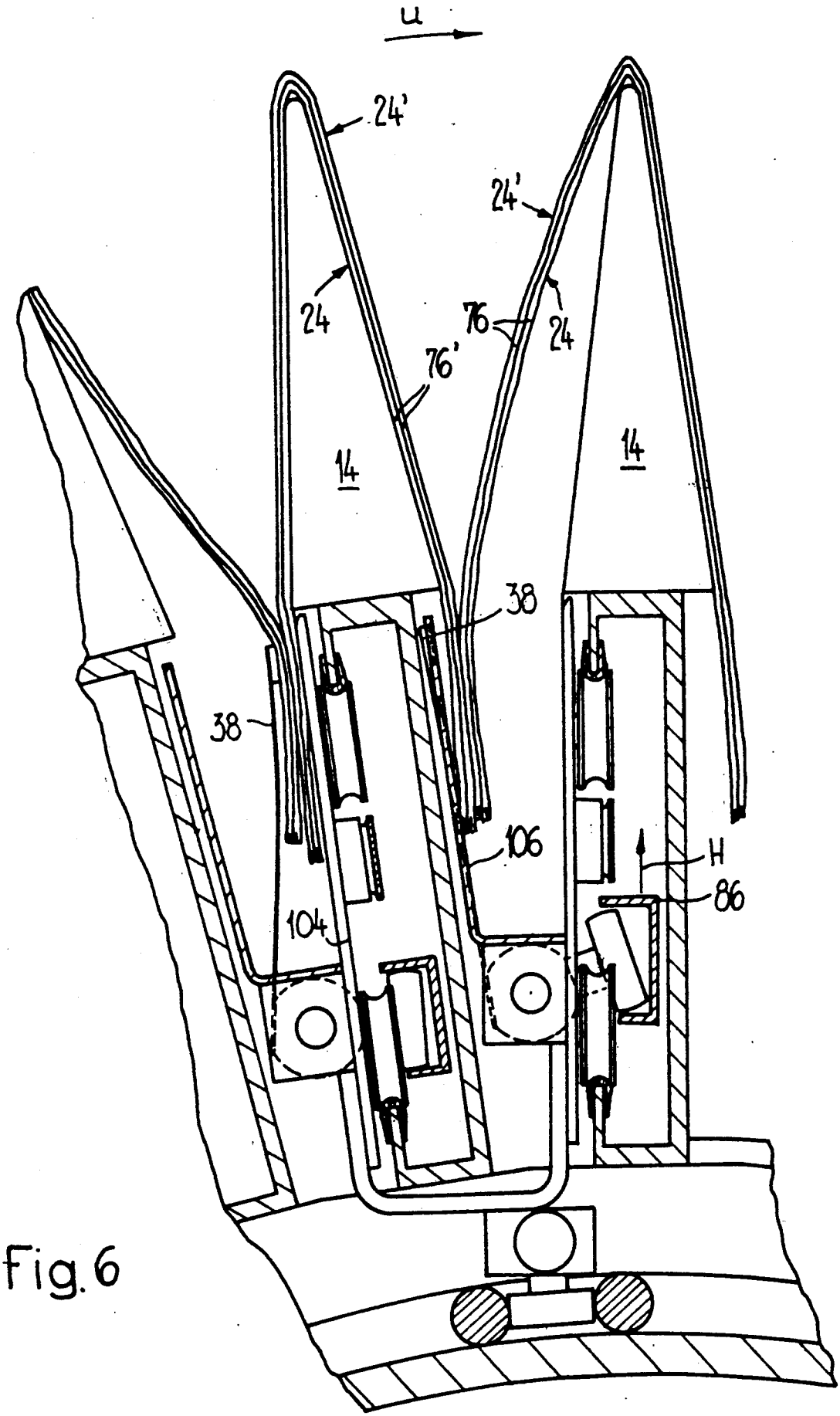

FIG. 6 shows the same section as FIG. 5, but two printed sheets 24, 24' are placed on top of one another astride each support 14, and the supports 14 are in the region D of FIG. 2. For the detailed description of this FIG. 6 you are referred to FIG. 5, since the layout of the device is the same in these two figures. The leading clamping tongues 38, viewed in the direction of rotation U, are in their open position, since the rail section 86 concerned, viewed in arrow direction H, is in its upper, radially outer end position. As a result of their own weight, the printed sheet halves 76, 76' now rest against the guide element 106. The rear clamping tongues 38, viewed in the direction of rotation U, are still in their closed position and clamp between them and the wall element 104 the rear and front printed sheet halves 76, 76' respectively of two printed sheets 24, 24' lying on top of one another.

Figure 7:
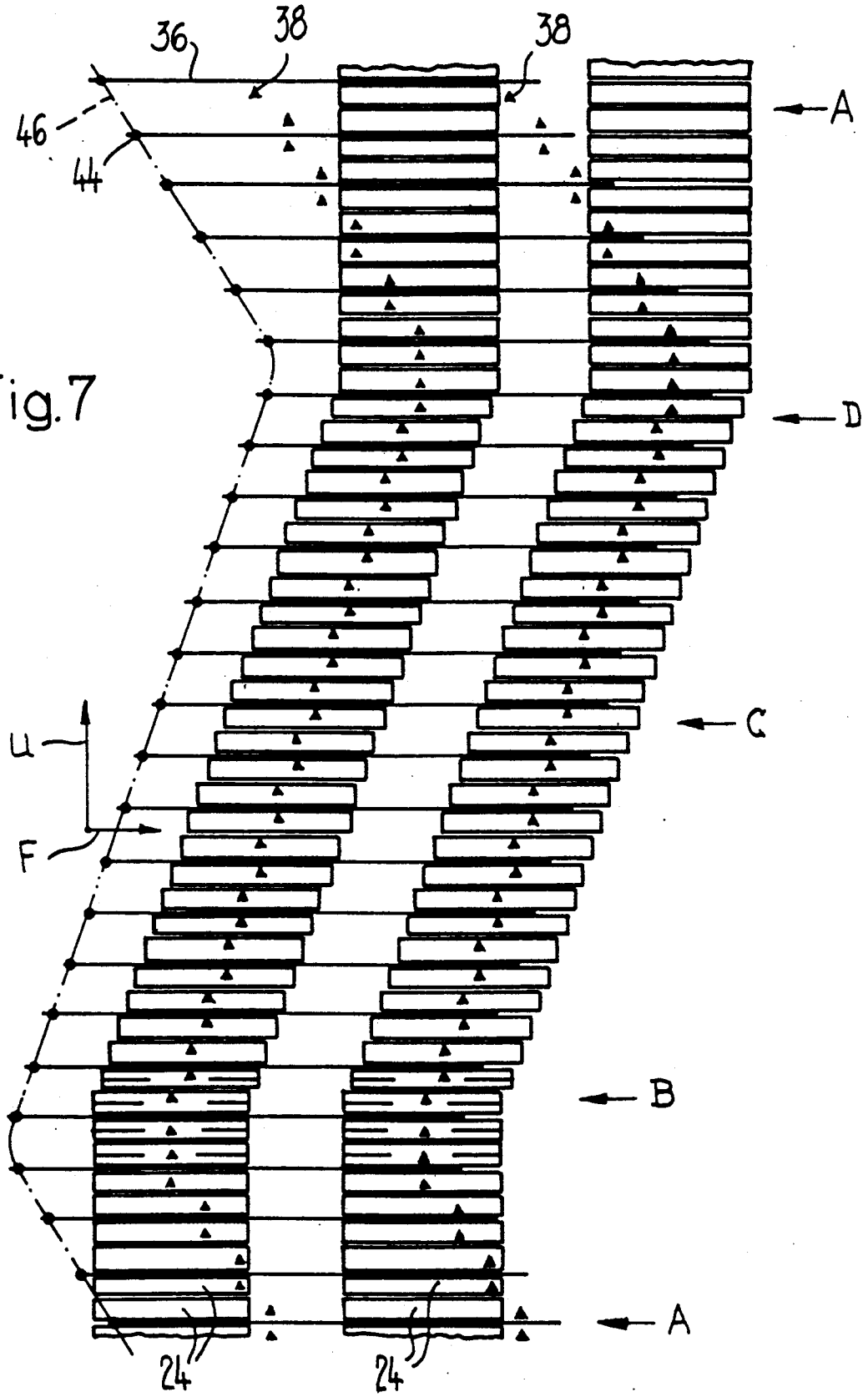
FIG. 7 shows the layout of part of the conveyor line of the printed sheets.

In FIG. 7 the collection operation is shown schematically in simplified form, with the aid of a layout, only the region of the first two feed conveyors 18 (FIG. 1) being shown. The layout of the control link 46 is indicated by a dashed and dotted line 46. The carriers 44 guided in the control link 46 are indicated by dots, each carrier 44 moving the carriages 36 of two supports 14 following one another (see also FIGS. 5 and 6). The dashes indicated by 36 symbolize the carriages of every other support 14. Only one carriage per support 14 with two clamping tongues 38 is shown in each case. The direction of rotation is indicated by U, and the direction of the conveyance stroke by F. The arrows A to D refer to the regions indicated by the same letters in FIG. 2.

The device shown in FIGS. 1 to 7 works as follows, as emerges particularly from FIG. 2, the collection drum 12 is driven by means of the drive motor 54 in the direction of rotation U. In this connection the carriers 44 run in the control link 46 of the control cylinder 48. Since this control cylinder 48 is stationary, the carriages 36 in the course of a revolution now carry out a conveyance stroke in arrow direction F and a return stroke opposite to arrow direction F (cf. FIG. 7). The distance which is covered here in one direction is slightly greater than the distance between any two feed conveyors 18. The control cylinder 48 is positioned in such a way here that the carriages 36 in the course of a revolution carry out the return stroke opposite to arrow direction F essentially while passing through the upper half (between D and B) of the trajectory and the conveyance stroke in arrow direction F while passing through the lower half (between B and D). while it should be noted that the clamping tongues 38 are in the open position during the entire return stroke.

In region A (see FIGS. 2 and 7) an open printed sheet 24 is placed astride each support 14 by the first feed conveyor 18 viewed in the direction of the arrow F. while the appropriate carriages 36 with open clamping tongues 38 are passing below the printed sheets 24 in the return stroke. The printed sheets 24 are not influenced by the carriages 36 during their return stroke, because all parts of the carriages 36 are set back or arranged inwards in the radial direction relative to the saddle-type supports 14. In the course of further rotation in the direction of rotation U towards region B, the rear printed sheet halves 76 and the front printed sheet halves 76' of the rear printed sheets 24, viewed in the direction of the arrow U, deposit themselves as a result of their own weight against the wall elements 104 of the carriages 36 (see also FIG. 5). In the region B the clamping tongues 38 of all carriages 36 attached to a support 14 are taken together from their open position to the closed position. It should be noted here that the clamping tongues 38 preferably are not taken into the closed position until, viewed in the direction of the arrow F. they are at the same speed as the printed sheets 24 already being held by the front clamping tongues 38. Since thereby the leading printed sheets 24 in each case are carried along in the direction of the arrow F earlier in terms of time than the rear printed sheets 24, these printed sheets 24 are staggered relative to each other, as can be seen in particular in FIGS. 4 and 7. A zigzag line is thus formed from the printed sheets 24, in which two adjacent printed sheets 24 in each case are staggered relative to each other in the direction of the arrow F. In the course of further rotation between the regions B and D the carriages 36 carry out the conveyance stroke, which leads to the zigzag line being taken together in the direction of the arrow F into the region of the next feed conveyor 18. In the region D all clamping tongues 38 of the carriages 36 which are attached to a support 14 are now opened together. This takes place before the two clamping tongues 38 holding a printed sheet 24 by the two printed sheet halves 76, 76' are subjected to a relative speed. This means that the clamping tongues 38 are opened before the relevant carriages 36 are braked to start their return stroke; the clamping tongues 38 of the relevant carriages 36 are therefore in their closed position only as long as the carriers 44 of these carriages 36 are in the region of the control link 46 with constant gradient (see FIG. 3).

Through the opening of the clamping tongues 38 the printed sheets 24 lying on the relevant support 14 and the leading printed sheet halves 76 of the printed sheets 24 resting on the following support 14 are now released. This means that the released printed sheets 24 are only moved on in the direction of rotation U, but are no longer conveyed in the direction of the arrow F, the result of which is that all printed sheets 24 released at position D as regards the arrow direction F come to rest at the same point and between the positions D and B are not subjected to any further movement in arrow direction F. As soon as the clamps 38 of the two carriages 36 influenced by a carrier 44 are now opened these carriages 36 are braked and accelerated in the opposite direction to the arrow F, which introduces the return stroke of the carriages 36.

A further printed sheet 24' is placed congruently by the next feed conveyor astride the printed sheets 24 thus conveyed by the first feed conveyor 18 to the next feed conveyor during a revolution of the collection drum 12. The printed sheets 24, 24' lying on top of one another are now first clamped to the leading printed sheet halves 76' in a similar manner to that shown further back, and advanced in the direction of the arrow F, also clamped to the rear printed sheet halves 76 and are conveyed in arrow direction F to the next feed conveyor 18, where a further printed sheet is placed on them. This is repeated until, as shown in FIG. 1, ten printed sheets are lying on top of each other. In the course of the next two revolutions these collected printed sheets 24, 24' are conveyed to the discharge conveyor 22, where they are seized by its grippers and conveyed away thus collected.

Figure 8:
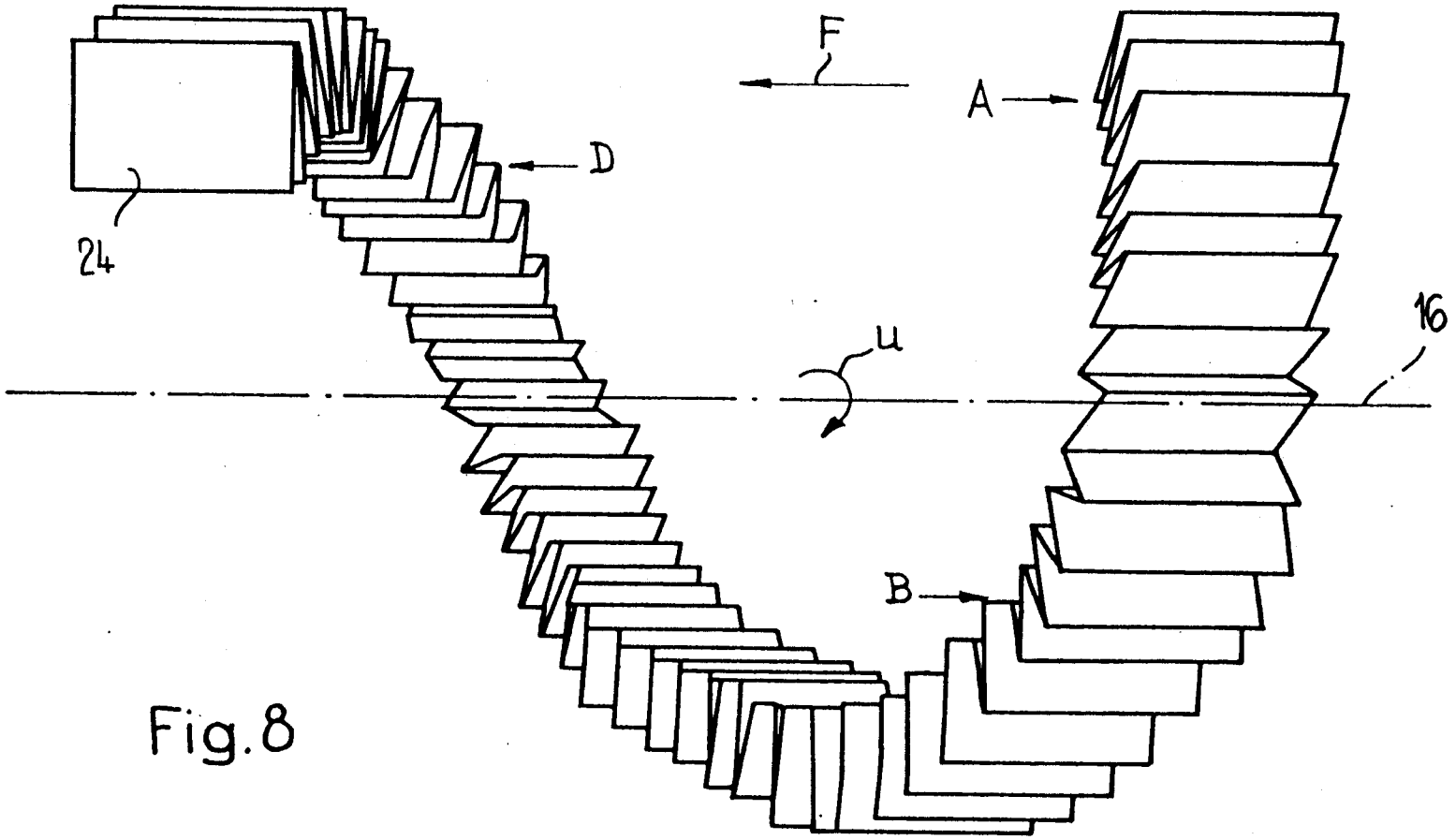
FIG. 8 shows in perspective from the side a part of the printed sheets disposed in the collection drum shown in FIG. 1.

FIG. 8 shows in perspective the zigzag line of printed sheet 24 between two feed conveyors 18, viewed from the side. The axis of rotation 16 (see FIG. 2) is shown by dotted and dashed lines.

The direction of rotation is indicated by U and the direction of the conveyance stroke by F. It should be noted that between the positions indicated by A and B the side edges of the printed sheets 24 are aligned with each other and thus in the direction of the conveyance stroke F do not undergo any displacement. At the positions indicated by B the printed sheets 24 are always staggered relative to each other in the direction of the arrow F, and this displacement remains until the position indicated by D is reached, when this displacement is removed again.

The collection drum 12 can be made up of sections, viewed in the direction of the arrow F (see FIG. 1). A basic section is advantageously three processing stations wide (two feed conveyors 18 and a discharge conveyor 20). Sections the width of, for example one or two processing stations (feed conveyors 18) can be added to or inserted in this basic section. Depending on the number of operations to be carried out, e.g. the number of printed sheets 24 24' to be placed on top of one another, such sections can thus be combined to form a collection drum 12 of greater length. The carriages 36 and rail sections 86 attached to each support 14 can be connected here by means of coupling elements 82 or connecting pieces 102 so that they can be moved together. The supports 14 are, of course, made up of sections of the appropriate length.

In a collection drum 12 of a specific predetermined length each support 14 can have a single carriage 36 which has more than two clamping tongues 38. In this case the rail sections 86 can be sections of a single continuous rail per support. It is also possible for each carriage 36 to have only a single clamping tongue 38, and thus an appropriately large number of carriages 36 per support 14 are coupled together.

Of course, it is also possible for each printed sheet 24, 24' to be held by a printed sheet half 76, 76' by more than one clamping tongue 38. It is also conceivable for each feed conveyor 18 to feed in several printed sheets 24 disposed inside each other.

Finally, it should be mentioned that the hollow shaft 30 together with the control cylinder 48 and/or the link 96 can be disposed so that they swivel about the axis of rotation 16, in order to adapt the movement of the carriages 36 or the clamping tongues 38 independently of each other to the particular geometry of the feed and discharge conveyors 18, 22 and the size of the printed sheets 24, 24' to be processed. The link 96 can be designed in such a way that its guide face is variable or it is interchangeable with another link 96, in order to adjust the places of the closing or opening movement of the clamping tongues 38.

The rail sections 86 can also be designed, for example, in an L shape, in particular if the lever arms 112 are pretensioned in a swivel direction and are pressing the rollers 114 against the one flank of the rail sections 86.

The movement of the rail sections 86 can also be in a direction other than the radial direction H. It only has to be directed crosswise to the direction of movement of the carriages 36.

Furthermore, the feed conveyors 18 could be replaced by known feeders which feed the printed sheets 24, 24' to the supports.

The uses of the collection device claimed in EP-OS 00 95 603 or the corresponding U.S. Pat. No. 4,489,930 are extended to the extent that printed sheets can now also be conveyed along the lower track, without falling off the supports. This can be important, for example, if faults have occurred in the placing of the printed sheets, or if several printed sheets which are the same have to be placed on top of one another, so that the printed sheets already placed on the supports have to be conveyed back again to the beginning of the upper track.

I claim:

1. A device for the collection of folded printed sheets comprising:

a plurality of saddle-type supports mounted for rotation along a closed trajectory and disposed parallel to each other and substantially at right angles to a direction of rotation, said supports adapted to receive at least two printed sheets astride the supports placed on top of each other by means of at least two spaced apart feed stations for transport to a discharge station for removal of the collected printed sheets, each printed sheet having two sheet halves, each sheet half of the deposited printed sheets resting on a respective side of the respective support; and clamping means associated with the supports and operative to hold the deposited printed sheets at the sheet halves along at least part of the trajectory;

wherein said clamping means comprises a plurality of clamping arrangements, each related to two adjacent supports in order to clamp together facing portions of printed sheets placed on the two related adjacent supports.

2. The invention of claim 3 wherein the supports are disposed around a common, essentially horizontal axis of rotation, and wherein the clamping arrangements clamp the printed sheets at least during a lower half of the trajectory.

3. A device for the collection of folded printed sheets comprising:

a plurality of saddle-type supports mounted for rotation along a closed trajectory and disposed parallel to each other and substantially at right angles to a direction of rotation, said supports adapted to receive at least two printed sheets astride the supports placed on top of each other by means of at least two spaced apart feed stations for transport to a discharge station for removal of the collected printed sheets;

a plurality of clamping arrangements associated with the supports and operative to hold the deposited printed sheets along at least part of the trajectory; and means for shifting the clamping arrangements in a lengthwise direction with respect to the supports.

4. The invention of claim 3 wherein each of the clamping arrangements comprises a respective clamp.

5. The invention of claim 3 further comprising means for moving the clamping arrangements from an open position to a closed position and vice versa independently of the shifting means.

6. The invention of claim 5 wherein each clamping arrangement is related to two adjacent supports in order to clamp together facing portions of printed sheets placed on the two related adjacent supports.

7. The invention of claim 3 wherein each of the clamping arrangements is disposed on a respective carriage, and wherein each carriage is coupled to the shifting means for movement lengthwise of the supports.

8. The invention of claim 7 wherein the shifting means shifts the carriages in a conveyance stroke and a return stroke corresponding at least to the distance between the two feed stations, and wherein the invention further comprises means for moving the clamping arrangements from an open position to a closed position and from the closed position to the open position for the return stroke.

9. The invention of claim 8 wherein the carriages are disposed between adjacent supports, and wherein the carriages disposed on either side of every other support are coupled together to move in synchronism through the conveyance and return strokes.

10. The invention of claim 8 wherein the clamping arrangements comprise clamping tongues mounted to swivel shafts oriented substantially parallel to the supports such that rotation of the swivel shafts causes the clamping tongues to clamp the printed sheets against the carriages.

11. The invention of claim 10 wherein the swivel shafts are mounted on the respective carriages for rotation by the moving means.

12. The invention of claim 11 wherein the moving means comprises a plurality of rail-type control elements running substantially parallel to a lengthwise direction defined by the supports, and means for shifting the control elements crosswise to the lengthwise direction; and wherein each swivel shaft comprises at least one lever arm having a free end guided on the respective control element.

13. The invention of claim 12 wherein the control elements which act on the lever arms of the shafts mounted on all of the carriages disposed between a pair of adjacent supports are operatively connected together.

14. The invention of claim 13 wherein the control elements which act on the lever arms of the shafts mounted on all of the carriages disposed between a pair of adjacent supports are sections of a single rail.

15. The invention of claim 12 wherein the control elements are C-shaped in cross section, and wherein the free end of each lever arm mounts a guide element guided in the respective control element.

16. The invention of claim 15 wherein each guide element comprises a roller rotatably mounted to the respective lever arm.

17. The invention of claim 12 wherein the carriages are guided on rails, and wherein one of each rail and the respective control element is mounted on at least two parallel, rotatably mounted rocking levers of equal length in order to provide movement crosswise to the lengthwise direction by the moving means.

18. The invention of claim 5 wherein the moving means comprises means for closing one of the clamping arrangements only when said one of the clamping arrangements is moving at at least approximately the same speed in a lengthwise direction defined by the supports as a circumferentially adjacent clamping arrangement.

19. The invention of claim 18 wherein the shifting means comprises a fixed control link acting on the clamping arrangements and having a region with a gradient that is at least approximately constant with respect to the direction of rotation, and the clamping arrangements are controlled by the moving means to close each clamping arrangement at the earliest when the clamping arrangement is influenced by the constant gradient region and to open each clamping arrangement before the preceding clamping arrangement, viewed in the direction of rotation, leaves the constant gradient region.

* * * * *